US009976532B2

(12) United States Patent
Fujita et al.

(10) Patent No.: US 9,976,532 B2
(45) Date of Patent: May 22, 2018

(54) RECOIL STARTER

(71) Applicants: Hirotoshi Fujita, Tokyo (JP); Shigemitsu Chigira, Tokyo (JP)

(72) Inventors: Hirotoshi Fujita, Tokyo (JP); Shigemitsu Chigira, Tokyo (JP)

(73) Assignee: STARTING INDUSTRIAL CO., LTD., Tokyo (JP)

( * ) Notice: Subject to any disclaimer, the term of this patent is extended or adjusted under 35 U.S.C. 154(b) by 7 days.

(21) Appl. No.: 14/944,908

(22) Filed: Nov. 18, 2015

(65) Prior Publication Data

US 2016/0138546 A1 May 19, 2016

(30) Foreign Application Priority Data

Nov. 19, 2014 (JP) ..... 2014-234419

(51) Int. Cl.
*F02N 3/02* (2006.01)
*F02N 15/10* (2006.01)
*F02N 15/02* (2006.01)

(52) U.S. Cl.
CPC ..... *F02N 3/02* (2013.01); *F02N 15/026* (2013.01); *F02N 15/10* (2013.01); *F02N 15/023* (2013.01); *F02N 15/027* (2013.01)

(58) Field of Classification Search
CPC . F02N 3/02; F02N 5/02; F02N 15/026; F02B 63/02
See application file for complete search history.

(56) References Cited

U.S. PATENT DOCUMENTS 3,871,350 A 3/1975 Hamman
4,492,190 A * 1/1985 Greenwood ..... F02N 3/02 123/185.2
4,582,030 A * 4/1986 Reese ..... F02B 63/02 123/185.3
4,928,643 A * 5/1990 Kampichler ..... F02N 3/02 123/185.3

(Continued)

FOREIGN PATENT DOCUMENTS

CN 1497166 5/2004
CN 2620773 6/2004

(Continued)

OTHER PUBLICATIONS

Machine Translation of JP10184500A.*

(Continued)

*Primary Examiner* — Long T Tran
(74) *Attorney, Agent, or Firm* — Nixon & Vanderhye P.C.

(57) ABSTRACT

One aspect of the invention provides a recoil starter including: a reel support shaft; a rope reel that is rotatably mounted on the reel support shaft; a ratchet member that is swingably mounted on the rope reel; a ratchet guide that is rotatably mounted on the reel support shaft with friction resistance. The ratchet guide includes: a guide portion and a swinging-prevention portion. When the rope reel rotates in an engine starting direction, the guide portion pushes out the ratchet member to an outer diameter direction. When the ratchet member does not contact the guide portion, the swinging-prevention portion prevents the ratchet member from swinging to the outer diameter direction.

3 Claims, 5 Drawing Sheets

(56) References Cited

U.S. PATENT DOCUMENTS

| | | | | |
|---|---|---|---|---|
| 5,014,657 | A * | 5/1991 | Tsunakawa | F02N 3/02 123/185.3 |
| 5,862,787 | A * | 1/1999 | Unuma | F02N 3/02 123/185.3 |
| 6,684,843 | B1 * | 2/2004 | Yoshida | F02B 61/045 123/185.2 |
| 8,616,170 | B2 * | 12/2013 | Horikoshi | F02N 3/02 123/185.3 |
| 9,074,569 | B2 * | 7/2015 | Nieda | F02N 3/02 |
| 2003/0037750 | A1 * | 2/2003 | Ueda | F02N 3/02 123/185.14 |
| 2004/0107935 | A1 | 6/2004 | Nieda et al. | |
| 2013/0152896 | A1 * | 6/2013 | Matsui | F02N 3/02 123/185.3 |
| 2013/0186363 | A1 * | 7/2013 | Nieda | F02N 1/02 123/185.3 |

FOREIGN PATENT DOCUMENTS

| | | | |
|---|---|---|---|
| CN | 202970998 | | 6/2013 |
| EP | 1 406 007 | | 4/2004 |
| GB | 2 218 470 | | 11/1989 |
| JP | 10184500 | A * | 7/1998 |
| JP | 2012-132430 | | 7/2012 |
| JP | 2014-132159 | | 7/2014 |

OTHER PUBLICATIONS

Extended European Search Report dated Apr. 13, 2016 issued in European Patent Application No. 15195206.6, 7 pp.

Chinese Office Action dated Jan. 18, 2018 issued in Chinese Patent Application No. 201510800219.4 and English translation, 13 pp.

* cited by examiner

RECOIL STARTER

CROSS-REFERENCE TO RELATED APPLICATION(S)

This application claims priority from Japanese Patent Application No. 2014-234419 filed on Nov. 19, 2014, the entire contents of which are herein incorporated by reference.

FIELD

The present invention relates to a recoil starter in which a rope reel is rotated by pulling a recoil rope, and the rotation of the rope reel is transmitted to a driving pulley connected to a crankshaft of an engine via a ratchet mechanism, thereby starting the engine.

BACKGROUND

A recoil starter may have a ratchet mechanism (for example, see JP-2012-132430-A and JP-2014-132159-A). In such recoil starter, a rope reel rotates in an engine starting direction by pulling a recoil rope. When the rope reel rotates in the engine starting direction, a ratchet provided thereon swings to the outer diameter direction to be engaged with the driving pulley, so that the rotation of the rope reel can be transmitted to the engine side. When the recoil rope is released, the rope reel rotates in a direction opposite to the engine starting direction by restoring force of a recoil spiral spring or the like, the ratchet swings to the inner diameter direction to be disengaged from the driving pulley so that the rotation on the engine side is not transmitted to the rope reel side after the engine starts. A spring may be used to retract the ratchet, that is, the spring may be disposed to push back the ratchet to the inner diameter direction when the recoil rope is released.

After the ratchet has been pushed back to the inner diameter direction by the urging force of the spring, force may be unintentionally exerted on the ratchet due to vibration or the like, and the ratchet may be unintentionally moved. If the ratchet is unintentionally moved and engaged with the driving pulley, the ratchet may be damaged or broken.

SUMMARY

One object of the present invention is to provide a recoil starter capable of holding a ratchet reliably in a retracted position when a rope reel rotates in a direction opposite to an engine starting direction.

A first aspect of the invention provides a recoil starter including:

a reel support shaft;

a rope reel that is rotatably mounted on the reel support shaft;

a ratchet member that is swingably mounted on the rope reel;

a ratchet guide that is rotatably mounted on the reel support shaft with friction resistance; and a friction spring that provides the friction resistance to the ratchet guide, wherein the ratchet guide includes:

a guide portion that pushes out the ratchet member to an outer diameter direction when the rope reel rotates in an engine starting direction; and a swinging-prevention portion that prevents the ratchet member from swinging to the outer diameter direction when the ratchet member does not contact the guide portion.

A second aspect of the invention provides, based on the above configuration, the recoil starter, wherein the ratchet guide is mounted on the reel support shaft at a side close to the engine as compared with the rope reel, and retains the rope reel with respect to the reel support shaft.

A third aspect of the invention provides, based on the above configuration, the recoil starter, wherein the guide portion is disposed to push out a forward end portion of the ratchet member to the outer diameter direction, and the swinging-prevention portion is disposed to face a rearward end portion of the ratchet member.

A fourth aspect of the invention provides, based on the above configuration, the recoil starter, wherein the ratchet guide includes a consecutive wall portion, and the consecutive wall portion form the guide portion and the swinging-prevention portion.

According to the first aspect, the ratchet guide includes the guide portion that pushes out the ratchet member to the outer diameter direction when the rope reel rotates in the engine starting direction, and the swinging-prevention portion that prevents the ratchet member from swinging to the outer diameter direction when the ratchet member does not contact the guide portion. Thus, the recoil starter is capable of reliably holding the ratchet member at a retracted position when the rope reel rotates in a direction opposite to the engine starting direction.

According to the second aspect, the ratchet guide further functions as a retainer that retains the rope reel with respect to the reel support shaft. Thus, one part, that is the ratchet guide, can provide at least three functions, so that the above-described effect can be obtained with a small number of parts count.

According to the third aspect, the guide portion is disposed to guide the forward end portion of the ratchet member to be engaged with the driving pulley, and the swinging-prevention portion is disposed to face the rearward end portion of the ratchet member. With this structure, even when the guide portion and the swinging-prevention portion are placed closely with each other, the ratchet member does not easily interfere with the swinging-prevention portion when swinging to the outer diameter direction, and does not easily interfere with the guide portion when swinging to the inner diameter direction. That is, the guide portion and the swinging-prevention portion can be placed closely with each other, and it is possible to reduce a free running distance until the ratchet member is engaged with a driving pulley from when the rope reel is rotated to start the engine can be reduced.

According to the fourth aspect, the guide portion and the swinging-prevention portion are provided as parts of the consecutive wall portion. Thus, the ratchet guide can be strengthened by the consecutive wall portion. Even when the ratchet receives unintentional force from the driving pulley, the ratchet can be supported by the consecutive wall portion.

DETAILED DESCRIPTION

An embodiment will be described with reference to the drawings.

Figure 1:
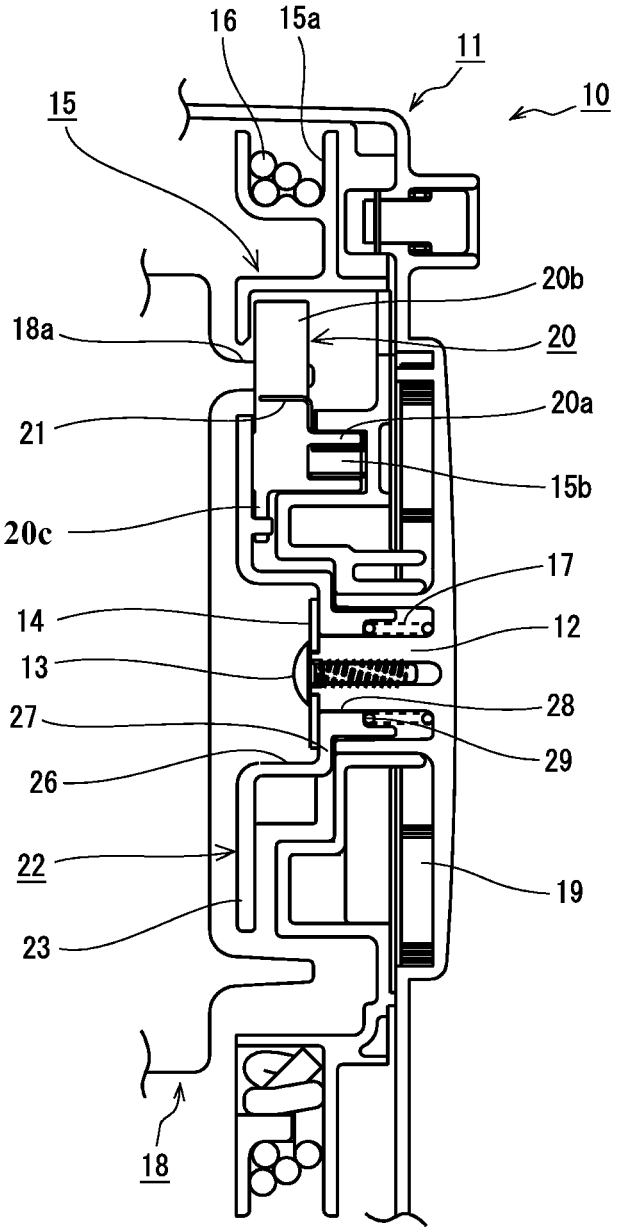
FIG. 1 is a cross-sectional view of a recoil starter.

As shown in FIG. 1, a recoil starter 10 according to the embodiment includes a starter case 11, a rope reel 15, the recoil rope 16, a recoil spiral spring 19, ratchet members 20, ratchet urging members 21, a driving pulley 18, a ratchet guide 22 and a friction spring 17. The rope reel 15 is rotatably mounted on the starter case 11. The recoil rope 16 is wound on a periphery of the rope reel 15. The recoil spiral spring 19 is disposed in the starter case 11 to urge the rope reel 15 in a direction of rewinding the recoil rope 16. The ratchet members 20 are swingably mounted on the rope reel 15, and the ratchet urging members 21 are disposed to urge the ratchet members 20 toward their retracted positions. The driving pulley 18 is attached to a crankshaft of an engine, and is engageable with the ratchet members 20. The ratchet guide 22 is rotatably mounted on the starter case 11, and the friction spring 17 urges the ratchet guide 22 to thereby provide friction resistance to the ratchet guide 22.

As shown in FIG. 1, the recoil starter 10 may be mounted on a side surface portion of the engine (although not illustrated, the crankshaft of the engine exists on the left side in FIG. 1). The starter case 11 generally accommodates the components of the recoil starter 10. A reel support shaft 12 protrudes from the starter case 11. When the recoil starter 10 is mounted on the engine, the reel support shaft 12 faces the crankshaft of the engine. The rope reel 15 and the ratchet guide 22 are mounted on the reel support shaft 12, and a set screw 13 and a washer 14 are attached to a distal end of the reel support shaft 12 to thereby hold the rope reel 15 and the ratchet guide 22. The recoil starter 10 may be mounted on other portion of the engine than the side surface portion, depending on an arrangement of the engine, as long as the rotational force can be transmitted to the crankshaft of the engine.

The rope reel 15 has a wheel shape. A rope retention groove 15*a* is formed on a periphery of the rope reel 15. The recoil rope 16 is wound on the rope retention groove 15*a* of the rope reel 15. The rope reel 15 has a hole at a center thereof, and is rotatably mounted on the reel support shaft 12 such that the reel support shaft 12 passes through the center hole. Protrusions 15*b* are provided on eccentric positions on the rope reel 15, and the ratchet members 20 are mounted on the protrusions 15*b*. In this embodiment, the rope reel 15 has two protrusions 15*b*, and two ratchet members 20 are mounted thereon.

The recoil rope 16 is wound on the rope retention groove 15*a* of the rope reel 15. While one end of the recoil rope 16 is fixed to the rope reel 15, the other end is drawn out of the starter case 11 through an opening (not illustrated) provided to the starter case 11. By pulling the drawn-out recoil rope 16, the rope reel 15 is rotated on the reel support shaft 12 as a rotational axis, and the rotational force is transmitted to the engine to thereby start the engine.

The recoil spiral spring 19 is disposed between the starter case 11 and the rope reel 15. While one end of the recoil spiral spring 19 is fixed to the rope reel 15, the other end is fixed to the starter case 11. When the recoil rope 16 is pulled to rotate the rope reel 15, the rotational force is accumulated in the recoil spiral spring 19, and when the recoil rope 16 is released, the rotational force accumulated in the recoil spiral spring 19 rotates the rope reel 15 to thereby rewind the recoil rope 16.

Figure 2A:
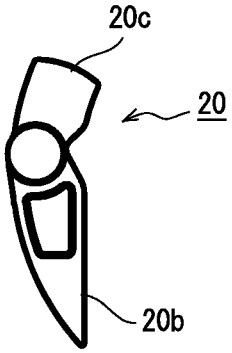
FIG. 2A is a front view of a ratchet member.
Figure 2B:
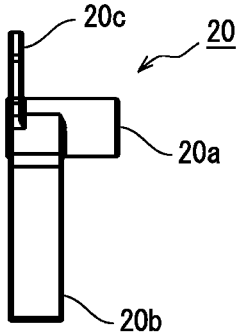
FIG. 2B is a side view of the same.

The ratchet members 20 have a pawl shape, and are swingably mounted on the rope reel 15. The ratchet members 20 are fitted onto the protrusions 15*b* of the rope reel 15 so as to be swingable around the protrusions 15*b* within a given angular range. As shown in FIGS. 2A and 2B, each of the ratchet members 20 includes a hole as a swinging shaft portion 20*a* to receive the protrusion 15*b* of the rope reel 15, a forward end portion 20*b* disposed on one side of the swinging shaft portion 20*a*, and a rearward end portion 20*c* disposed on the other side of the swinging shaft portion 20*a*. The "forward" direction corresponds to the rotational direction (the counter-clockwise direction in FIGS. 4A to 5B) of the rope reel 15 when the recoil rope 16 is pulled, and the "rearward" direction corresponds to the rotational direction (the clockwise direction in FIGS. 4A to 5B) of the rope reel 15 when the recoil rope 16 is rewound. The forward end portion 20*b* protrudes to the outer diameter direction of the rope reel 15 to be engaged with the driving pulley 18 when the rope reel 15 rotates. When the forward end portion 20*b* moves to the outer diameter direction, the rearward end portion 20*c* on the opposite side moves to the inner diameter direction.

Figure 4A:
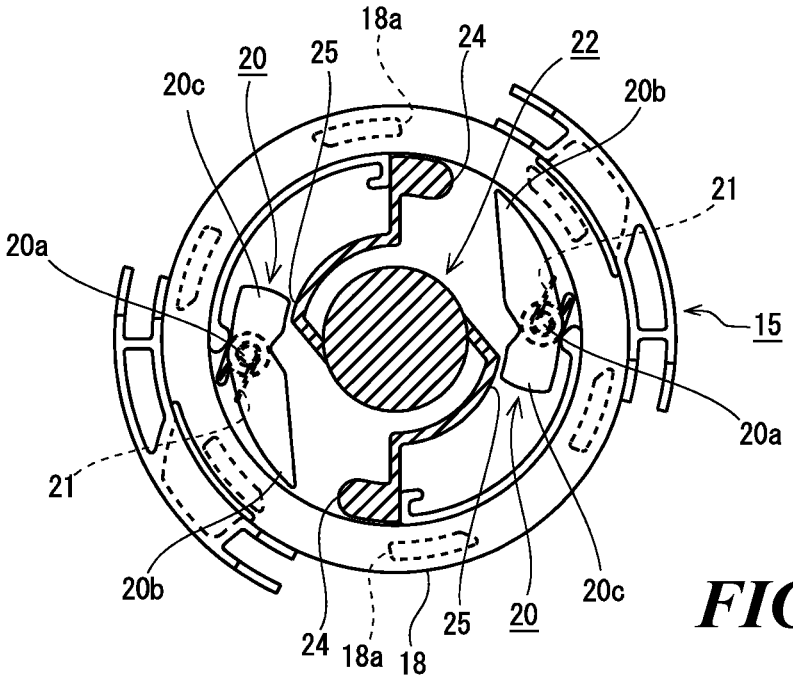
FIGS. 4A and 4B are explanatory views the operations of the ratchet member and the ratchet guide.

The ratchet members 20 are urged by the ratchet urging members 21. For example, the ratchet urging members 21 are configured by torsional coil springs. Thus, when the recoil starter 10 does not operate, the forward end portions 20*b* are brought into a state (the retracted position) of not protruding from the rope reel 15 as viewed from the direction of the rotational axis of the rope reel 15. This state is shown in FIG. 4A.

The driving pulley 18 is mounted on the crankshaft of the engine. The rotational force of the rope reel 15 is transmitted to the engine side through the driving pulley 18. As shown in FIG. 1, the driving pulley 18 includes receiving portions 18*a* that are disposed at regular intervals in the circumferential direction. The receiving portions 18*a* of the driving pulley 18 are engageable with the forward end portions 20*b* of the ratchet members 20.

Figure 3A:
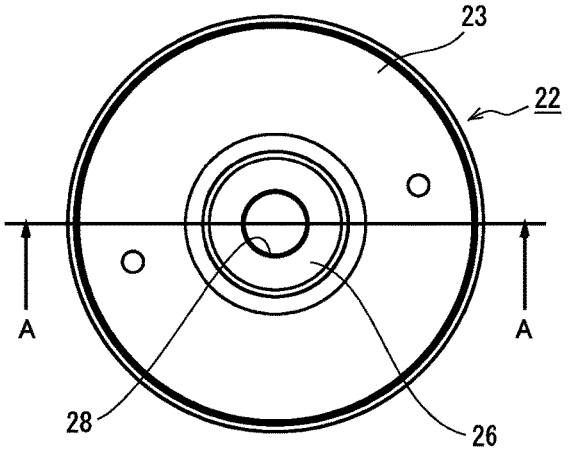
FIG. 3A is a front view of a ratchet guide.
Figure 3B:
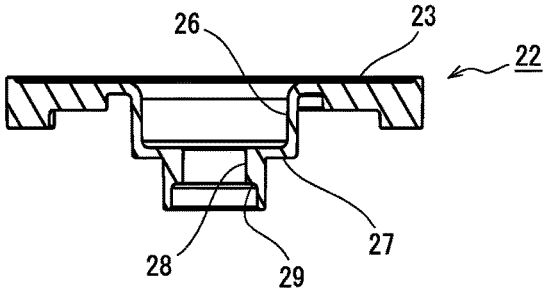
FIG. 3B is a cross-sectional view of the ratchet guide taken along the line A-A of FIG. 3A.
Figure 3C:
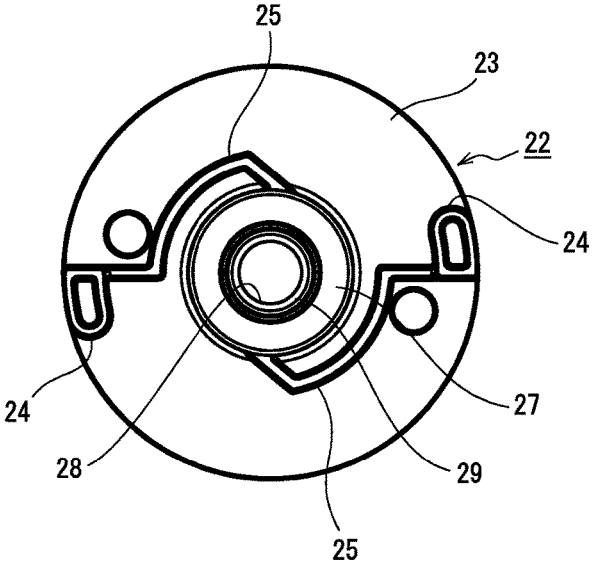
FIG. 3C is a back view of the ratchet guide.

As shown in FIGS. 3A to 3C, the ratchet guide 22 generally has a circular shape. The ratchet guide 22 is rotatably mounted on the reel support shaft 12 with friction resistance, which is provided by the friction spring 17.

As shown in FIGS. 3A to 3C, the ratchet guide 22 according to this embodiment includes a flange portion 23 having a circular disc shape, and a concave portion 26 disposed in the center of the flange portion 23.

Rib-like wall portions protrude in the thickness direction from the back surface of the flange portion 23. In this embodiment, each of the wall portions forms a guide portion 24 and a swinging-prevention portion 25. The guide portion 24 is formed to guide the forward end portions 20*b* of the ratchet members 20 to the outside (the outer diameter direction) of the rope reel 15 when the rope reel 15 rotates in the engine starting direction. The swinging-prevention portions 25 are formed to prevent the ratchet members 20 from swinging to the outside (the outer diameter direction)

of the rope reel 15 when the ratchet members 20 do not contact the guide portions 24. In this embodiment, the swinging-prevention portion 25 is formed as a part of the wall portion which extends in the circumferential direction around the axis of the ratchet guide 22.

The concave portion 26 of the ratchet guide 22 is provided with a through hole 28 in its center. In the assembled state, the reel support shaft 12 is inserted into the through hole 28. A part of the concave portion 26 is stepped to form a retaining portion 27. As shown in FIG. 1, in the assembled state, the retaining portion 27 faces the rope reel 15, thereby functioning as a retainer of the rope reel 15 with respect to the reel support shaft 12. Inside the concave portion 26, a spring-receiving portion 29 is provided to receive the friction spring 17.

The friction spring 17 is disposed between the starter case 11 and the ratchet guide 22, and urges the ratchet guide 22 in a direction of being away from the starter case 11. Since the friction spring 17 urges the ratchet guide 22 toward the washer 14, predetermined friction resistance is provided to the ratchet guide 22.

The operation of the above-described recoil starter 10 will be described below.

Figure 4B:
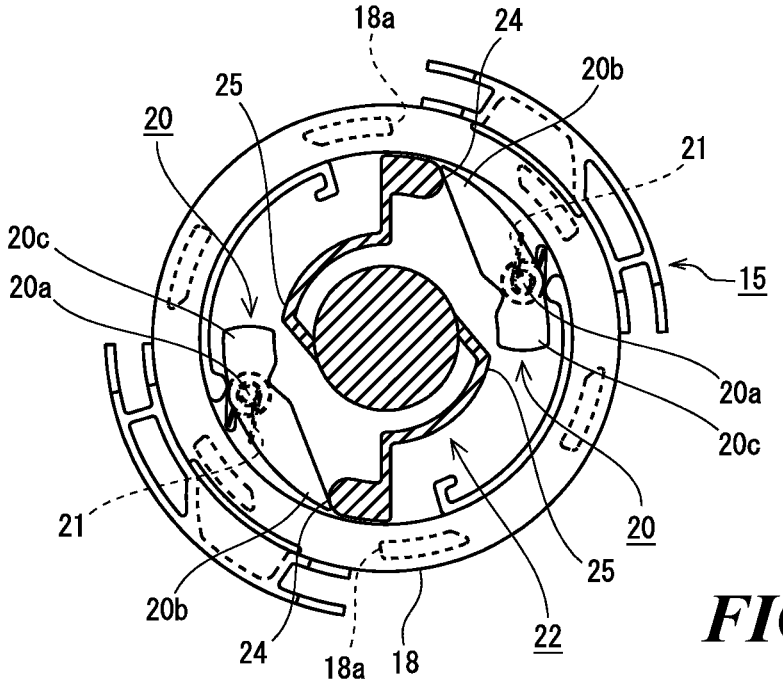
Figure 5A:
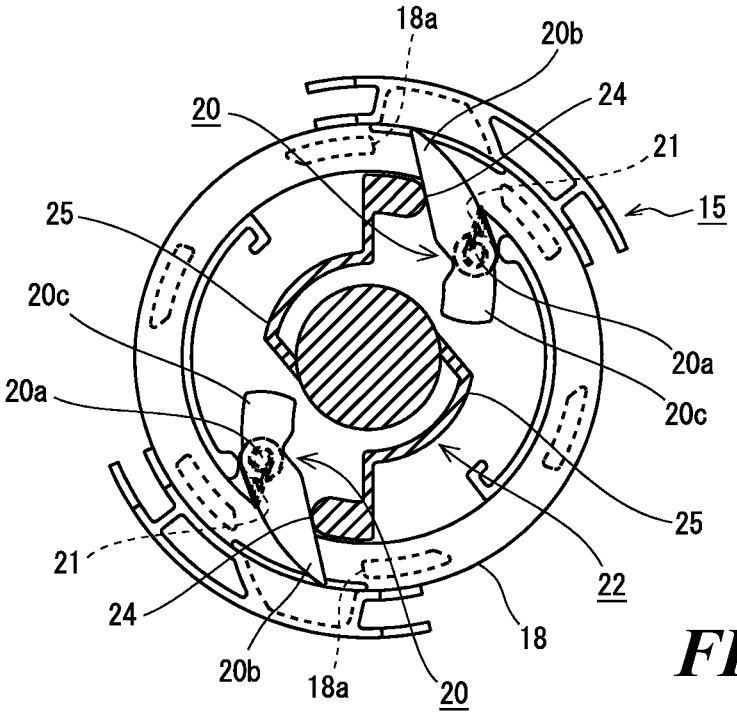
FIGS. 5A and 5B are explanatory views the operations of the ratchet member and the ratchet guide.

FIG. 4A shows the original state. When the recoil rope 16 is pulled from the original state in order to start the engine, the rope reel 15 rotates in the engine starting direction, and the ratchet members 20 rotate integrally with the rope reel 15. On the other hand, the ratchet guide 22 does not immediately rotate with the rope reel 15 because of the friction resistance provided between the ratchet guide 22 and the reel support shaft 12. As the ratchet guide 22 and the rope reel 15 rotate relatively, the forward end portions 20*b* of the ratchet members 20 contact the guide portions 24 of the ratchet guide 22 as shown in FIG. 4B. And, as the ratchet members 20 further rotate together with the rope reel 15, the forward end portions 20*b* of the ratchet members 20 are pressed onto the guide portions 24 of the ratchet guide 22, and are caused to swing and protrude to the outer diameter direction as shown in FIG. 5A. When the ratchet guide 22 and the rope reel 15 relatively rotate to the position shown in FIG. 5B, the ratchet guide 22 is locked by the rope reel 15 (the ratchet members 20), so that the ratchet guide 22 thereafter integrally rotates with the rope reel 15 against the friction resistance by the friction spring 17.

When the forward end portions 20*b* of the ratchet members 20 protrude to the outer diameter direction, the forward end portions 20*b* are engageable with the receiving portions 18*a* of the driving pulley 18. Thus, the driving pulley 18 also rotates integrally with the rope reel 15. As a result, the rotational force of the rope reel 15 can be transmitted to the driving pulley 18 (the engine side), thereby starting the engine.

Figure 5B:
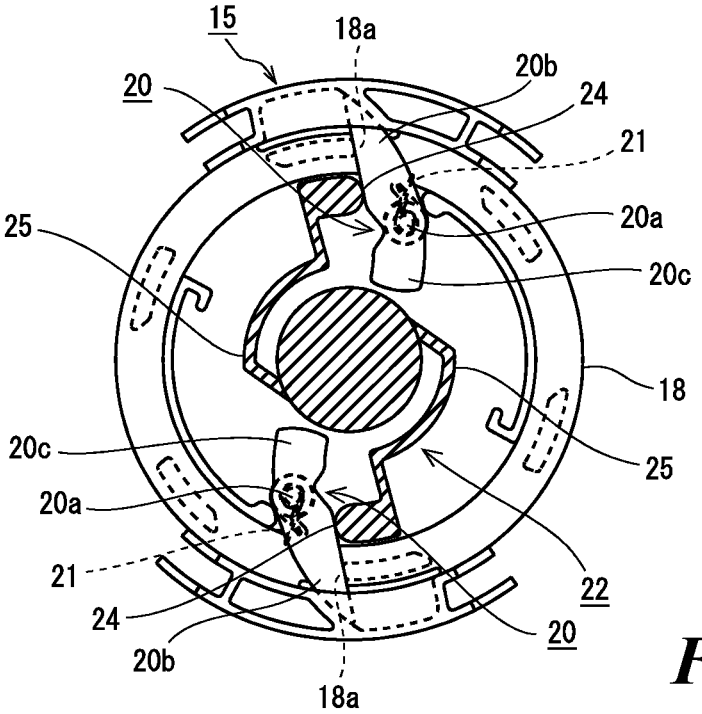

When pulling of the recoil rope 16 is finished, the rope reel 15 is rotated backward (rotated clockwise) from the state shown in FIG. 5B by the rotational force accumulated in the recoil spiral spring 19. Thus, the ratchet guide 22 and the rope reel 15 rotate relatively in the direction opposite to the previous rotation direction (the engine starting direction), the forward end portions 20*b* of the ratchet members 20 are separated from the guide portions 24, and the ratchet members 20 swing inwardly by the urging force of the ratchet urging members 21. With this operation, the ratchet members 20 swing until the ratchet members 20 return to the retracted position, as shown in FIG. 4A.

After the forward end portions 20*b* of the ratchet members 20 are separated from the guide portions 24 of the ratchet guide 22, force may be unintentionally exerted on the forward end portions 20*b* of the ratchet members 20 toward the outer diameter direction due to vibration or the like of the machine to which the recoil starter 10 is mounted. However, in this embodiment, even if such force is exerted, the ratchet members 20 can be reliably held at a retracted position because the swinging-prevention portions 25 are disposed at positions facing the rearward end portions 20*c* of the ratchet members 20 so as to prevent the forward end portions 20*b* of the ratchet members 20 from swinging outwardly, as shown in FIG. 4A.

In this embodiment, the guide portions 24 are disposed to guide the forward end portions 20*b* of the ratchet members 20 to be engaged with the receiving portions 18*a* of the driving pulley 18, and the swinging-prevention portions 25 are disposed to face the rearward end portions 20*c* of the ratchet members 20. With this structure, the guide portions 24 and the swinging-prevention portions 25 can be placed close to each other in the circumferential direction, thereby reducing a free running distance of the rope reel 15. The free running distance means a distance of movement from when a rotation of the rope reel 15 starts until when the ratchet members 20 are engaged with the driving pulley 18.

In this embodiment, the swinging-prevention portions 25 are disposed on the inner diameter side to contact the rearward end portions 20*c* of the ratchet members 20. On the other hand, theoretically, the swinging-prevention portions 25 may be provided on the outer diameter side to contact the forward end portions 20*b* of the ratchet members 20. In this case, the rib-like wall portions for forming the swinging-prevention portions 25 may protrude from an outer circumferential edge of the flange portion 23 of the ratchet guide 22.

However, if the swinging-prevention portions 25 are disposed on the outer diameter side, positions of the ratchet members 20 are moved to a further inner diameter side as compared with the case where the swinging-prevention portions 25 are disposed on the inner diameter side. As a result, a swinging amount required for causing the forward end portions 20*b* of the ratchet members 20 to protrude to the outer diameter direction to be engaged with the driving pulley 18 is increased. This results in a longer free running distance.

In addition, if the rib-like wall portions protrude from the outer circumferential edge of the flange portion 23 of the ratchet guide 22, the rib-like wall portions may be more easily deformed as compared with the case where the rib-like wall portions protrude from the inner diameter side of the flange portion 23. Also, it may become difficult to continuously form the swinging-prevention portions 25 with the guide portions 24 to thereby strengthen them.

According to this embodiment, the ratchet guide 22 includes the guide portions 24 that push out the ratchet members 20 to the outer diameter direction when the rope reel 15 rotates in the engine starting direction, and the swinging-prevention portions 25 that prevent the ratchet members 20 from swinging to the outer diameter direction when the ratchet members 20 do not contact the guide portions 24. Thus, the ratchet members 20 can be pushed back reliably to the retracted position when the rope reel 15 rotates in the direction opposite to the engine starting direction.

The ratchet guide 22 also functions as a retainer that retains the rope reel 15 with respect to the reel support shaft 12. Thus, one member, that is the ratchet guide 22, can have at least three functions of guiding the ratchet members 20 to be engaged with the driving pulley 18, preventing the ratchet members 20 from unintentionally swinging, and retaining the rope reel 15. Thus, many effects can be realized with a small parts count.

The guide portions 24 are disposed to guide the forward end portions 20*b* of the ratchet members 20 to be engaged with the receiving portions 18*a* of the driving pulley 18, and the swinging-prevention portions 25 are disposed to face the rearward end portions 20*c* of the ratchet members 20. With this structure, even when the guide portions 24 and the swinging-prevention portions 25 are placed close to each other, the ratchet members 20 do not easily interfere with the swinging-prevention portions 25 when swinging to the outer diameter direction, and do not easily interfere with the guide portions 24 when swinging to the inner diameter direction. That is, the guide portions 24 and the swinging-prevention portions 25 can be placed closely with each other, and it is possible to reduce a free running distance until the ratchet members 20 are engaged with the driving pulley 18 from when the rope reel 15 is rotated to start the engine.

The ratchet guide 22 includes a plurality (two, in this embodiment) of the guide portions 24 and a plurality (two, in this embodiment) of the swinging-prevention portions 25, correspondingly with the number of the ratchet members 20. That is, the ratchet guide 22 can be applied for a ratchet mechanism having any number of the ratchet members 20. Thus, in the resulting recoil starter 10, stable engagement with the driving pulley can be realized through the plurality of ratchet members 20.

Since the guide portions 24 and the swinging-prevention portions 25 are formed by the consecutive wall portions, it is also possible to strengthen the ratchet guide 22 by the consecutive wall portions.

The invention claimed is:

1. A recoil starter including:

a reel support shaft;

a rope reel that is rotatably mounted on the reel support shaft;

a ratchet member that is swingably mounted on the rope reel via a swinging shaft portion, one side of the swinging shaft portion being a forward end portion of the ratchet member, and an opposite side of the swinging shaft portion being a rearward end portion of the ratchet member;

a ratchet guide that is rotatably mounted on the reel support shaft with friction resistance; and a friction spring that provides the friction resistance to the ratchet guide, wherein the ratchet guide includes:

a guide portion that pushes out the ratchet member to an outer diameter direction when the rope reel rotates in an engine starting direction; and a swinging-prevention portion that prevents the ratchet member from swinging to the outer diameter direction when the ratchet member does not contact the guide portion, wherein no portion of the ratchet member from the swinging shaft portion to the rearward end portion maintains contact with the ratchet guide when the forward end portion engages the guide portion, wherein the ratchet guide includes a consecutive wall portion, and the consecutive wall portion form the guide portion and the swinging-prevention portion.

2. The recoil starter of claim 1, wherein the ratchet guide is mounted on the reel support shaft at a side close to the engine as compared with the rope reel, and retains the rope reel with respect to the reel support shaft.

3. The recoil starter of claim 1, wherein the guide portion is disposed to push out a forward end portion of the ratchet member to the outer diameter direction, and the swinging-prevention portion is disposed to face a rearward end portion of the ratchet member.

* * * * *